United States Patent [19]

Bonner

[11] Patent Number: 4,982,625

[45] Date of Patent: Jan. 8, 1991

[54] ADAPTOR AND DRIVER FOR AN ADHESIVE CAPSULE ANCHOR

[75] Inventor: Ben V. Bonner, Bloomfield Hills, Mich.

[73] Assignee: A.T. & G. Company, Inc., Farmington Hills, Mich.

[21] Appl. No.: 928,864

[22] Filed: Nov. 10, 1986

[51] Int. Cl.[5] ..... B25B 13/50

[52] U.S. Cl. ..... 81/53.2; 81/121.1; 81/125; 81/459

[58] Field of Search ..... 81/53.2, 125, 121.1, 81/459

[56] References Cited

U.S. PATENT DOCUMENTS

| | | | |
|---|---|---|---|
| 2,326,317 | 8/1943 | Amtsberg | 81/124.6 |
| 2,622,466 | 12/1952 | Vanden Bos et al. | 81/53.2 |
| 3,292,463 | 12/1966 | McKean | 81/53.2 |
| 3,368,430 | 2/1968 | Levering | 81/53.2 |

*Primary Examiner*—Frederick R. Schmidt
*Assistant Examiner*—M. Rachuba
*Attorney, Agent, or Firm*—Robert G. Mentag

[57] ABSTRACT

An adaptor and driver unit for rotatably inserting threaded anchors into a seating position in drilled holes in rock, masonry, concrete and the like, comprising a driver with a threaded hole on the lower end into which the upper end of a threaded anchor is releasably mounted, and an adaptor releasably attached to the upper end of the driver and being adapted to be connected to a power drive means.

2 Claims, 2 Drawing Sheets

ADAPTOR AND DRIVER FOR AN ADHESIVE CAPSULE ANCHOR

BACKGROUND OF THE INVENTION

1. Technical Field

The field of art to which this invention pertains may be generally located in the class of devices relating to tools for installing threaded elements. Class 81, entitled Tools, United States Patent Office Classification, and in particular Subclass 53.2, appears to be the applicable general area of art to which the subject matter similar to this invention has been classified in the past.

2. Background Information

It is known in the construction art to employ threaded steel studs or anchors in holes formed in concrete, masonry, rock or the like, and to secure the studs or anchors in place by a chemical adhesive material. Heretofore, one method employed for inserting a threaded steel stud or anchor into a hole in concrete was to drop a breakable capsule filled with a chemical adhesive into the hole and then pound the stud or anchor into the hole. A disadvantage of the method of pounding a stud or anchor into a hole is that the capsule material is merely compacted into the hole and the chemical adhesive stayed mostly in the bottom of the hole in the concrete or the like. Another method of installing a chemical adhesive stud or anchor in a hole in concrete or the like, is shown in U.S. Pat. No. 4,404,875. The installer drive unit shown in the last mentioned patent includes a cylindrical shank which has a central portion having a hexagonal cross section and an upper end adapted to be inserted in a conventional chuck of a rotary drill. The lower end of the drive unit shank is provided with threads of the same pitch as a threaded stud or anchor which is to be inserted into a hole in concrete or the like. The drive unit is provided with a connector nut that is used to attach it to the threaded outer end of a stud or anchor. The distal end of the threaded portion of the drive unit is generally convex, so as to reduce friction with the flat end of the stud when the two are joined together by the connector nut. In order to release the nut from the stud after it is driven into a hole in concrete or the like, two wrenches are required. One wrench is required to hold the hexagonal portion of the drive unit and the other wrench is used to release the connector nut. A disadvantage of the last described structure of the installer unit of U.S. Pat. No. 4,404,875 is the fact that much time is lost on the job in having to manually release the drive unit with a pair of wrenches. The wrenches also comprise extra tools which must be employed in the use of the last mentioned drive unit.

U.S. Pat. Nos. 2,336,157, 2,933,960, 3,280,666, and 4,513,643 illustrate further examples of prior art tools for installing threaded studs and similar elements.

SUMMARY OF THE INVENTION

In accordance with the invention, an adaptor and driver unit is provided for rotatably driving a threaded anchor into a seating position in a hole in concrete, masonry, rock or the like, and into engagement with a capsule which carries a chemical adhesive for breaking the capsule and distributing the adhesive throughout the length of the hole. The driver includes a body with a threaded hole in a lower end thereof and an adaptor connector shaft hole in an upper end thereof. The threaded hole terminates with an inner end communicating with an undercut groove which is made to a diameter larger than the diameter of the threaded hole. The threaded hole terminates at an inner end wall which is formed with a conical, axial end surface for abutting engagement with the outer end of a threaded anchor which is threaded into said threaded hole. An adaptor is included which has a drive shaft seated in said connector shaft hole in the driver body. An attachment means is provided for releasably securing the adaptor connector shaft to the driver body. The attachment means includes a retainer pin which is operatively mounted in a transverse hole formed through the driver body and also through an aligned transverse hole formed through the adaptor connector shaft. A flexible O-ring is provided for releasably holding the retainer pin in said transverse holes. The O-ring is seated in a circumferential groove formed around the driver body and communicating with the ends of the transverse hole through the driver body.

DESCRIPTION OF THE PREFERRED EMBODIMENTS

Figure 1:
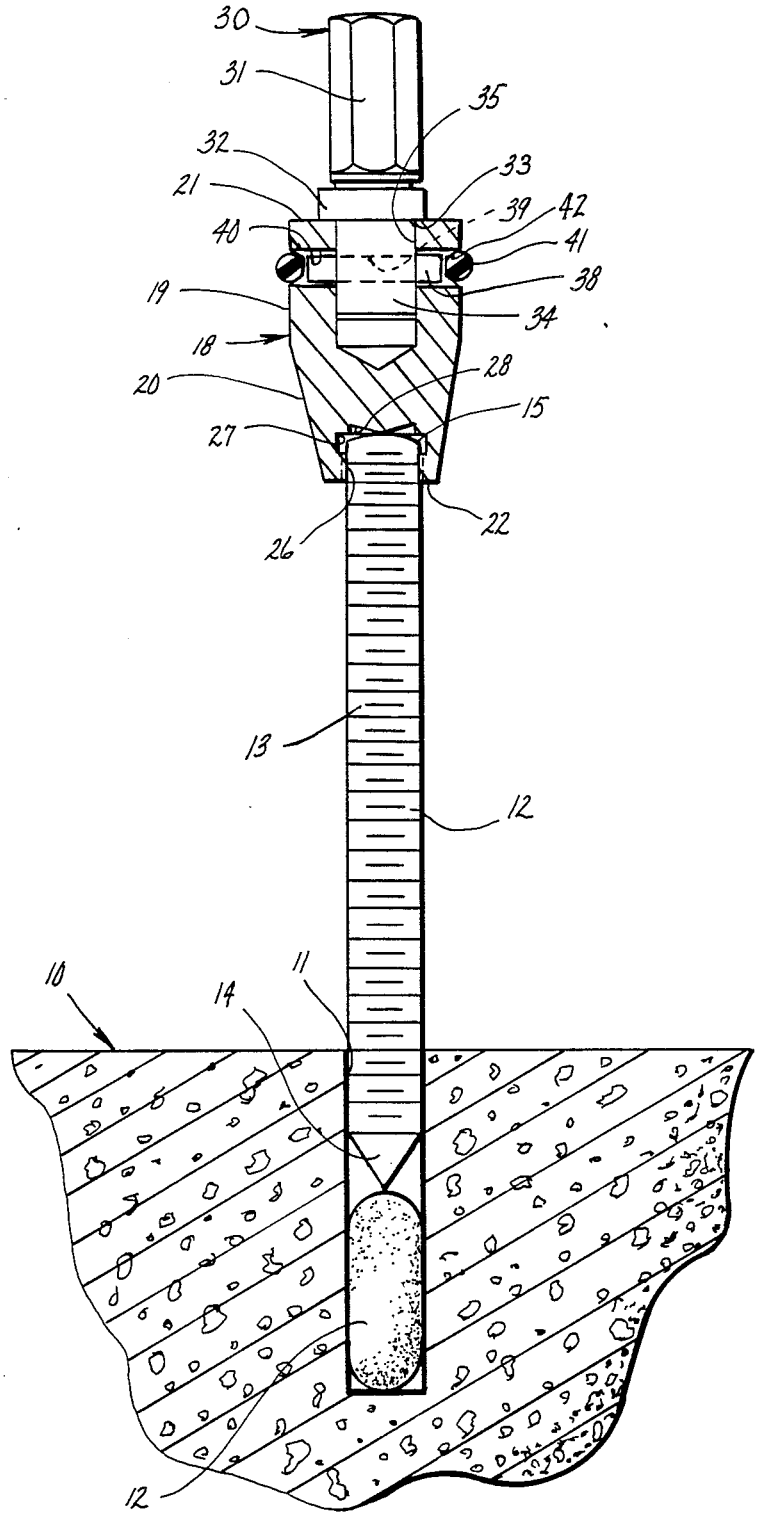
FIG. 1 is an elevation view, partially in cross section, of a first embodiment of an adaptor and driver unit for a chemical adhesive stud or anchor, made in accordance with principles of the present invention, and showing the adaptor and driver unit attached at one end to a threaded anchor. The threaded anchor is shown partially inserted into a drill hole in a concrete material, with the lower end of the anchor abutting a breakable capsule which carries a chemical adhesive material, and which is seated in the bottom of the hole.

Referring now to the drawings, and in particular to FIG. 1, the numeral 10 generally designates a concrete member which has formed therein a drill hole 11, in which is partially mounted the lower end of a threaded stud or anchor, generally indicated by the numeral 13. The numeral 12 designates a breakable capsule carrying a capsule of chemical adhesive material. The threaded anchor 13 comprises an elongated threaded rod which is provided with a conical or pointed lower end 14 and a convexly curved upper end 15.

The numeral 18 generally designates a driver made in accordance with the principles of the present invention. As shown in FIG. 1, the driver 18 has a body comprising an upper cylindrical portion 19 and an integral, lower conically shaped portion 20. The numerals 21 and 22 designate the upper and lower end surfaces of the driver 18. The driver 18 is provided on the lower end thereof with an inwardly extended axial, threaded hole 26 which terminates at an inner axial end wall and which communicates at its inner end with an undercut or enlarged diameter groove 27. The inner axial end wall of the 27 threaded hole 26 is formed with a downwardly tapered end face 28.

The numeral 30 generally designates an adaptor employed in the invention which includes a shank 31. The adaptor shank 31 is shown as being provided with a hexagonal periphery, but it will be understood that the periphery of the adaptor shank 31 may be provided with any suitable configuration as for example, cylindrical or splined. The adaptor shank 31 is connected at its lower end to an integral enlarged flange 32. An axially extended, cylindrical adaptor connector shaft 34 is connected integrally to the lower end of the flange 32. The adaptor connector shaft 34 is adapted to be slidably mounted in an inwardly extended axial bore 35 which is formed in the upper end of the driver 18. As shown in FIG. 1, the adaptor flange 32 is made to a diameter larger than the adaptor connector shaft 34, so as to provide an annular shoulder 33 which seats on the upper end 21 of the driver 18, when the adaptor 30 is connected to the driver 18, as shown in FIG. 1.

The adaptor 30 is releasably attached to the driver 18 by a retainer pin 38. The retainer pin 38 extends through a transverse bore 40 formed through the upper body portion 19 of the driver 18 and through an aligned transverse bore 39 formed through the adaptor connector shaft 34. The retainer pin 38 is held in an operative retaining position, as shown in FIG. 1, by means of a suitable O-ring 41, which is disposed around the periphery of the driver upper body portion 19 and is seated in a peripheral groove 42 which communicates with the transverse bore 40 in the driver 18.

In use, a breakable capsule 12, carrying a chemical adhesive material, is dropped into a drilled hole as 11 which has been cleaned of all dirt and dust. The hole 11 is drilled to an appropriate depth, and the diameter of the hole corresponds to the diameter of the anchor 13. The outer or upper end of the anchor 13 is threaded into the driver threaded hole 26 until the convex upper end 15 abuts the tapered end 28 of the undercut groove 27. The shank 31 of the adaptor 30 is operatively mounted in the chuck of a power drive means, such as an electric drill. The anchor 13 is then disposed over the hole 11 and threaded into the hole 11 by the drive means, so as to provide rotary and longitudinal action to the anchor 13, which is thus driven down into the bottom of the hole 11. As the anchor 13 is threaded into the hole 11, the conically pointed lower end 14 thereof engages the capsule 12 and a continuous rotary and downward movement of the anchor 13 into the hole 11 breaks the capsule 12, and the threads on the anchor 13 carry the chemical adhesive upwardly in the hole 11 to provide a uniform distribution of the chemical adhesive throughout the length of the hole 11. The anchor 13 is fixedly secured in position in the hole 11 by the chemical adhesive and the anchor 13 is ready for its intended use.

The undercut groove 27 and the tapered end face 28 in the driver 18 function to easily release the driver 18 when the anchor 13 is completely seated in the hole 11 in the concrete 10. The convex upper end 15 of the anchor 13 does not bind in the driver 18 because of the minimum contact area with the axial hole tapered end face 28, and the undercut groove 27, which provides room for any dirt to be expanded outwardly and not bind the anchor 13 to the driver 18.

Figure 2:
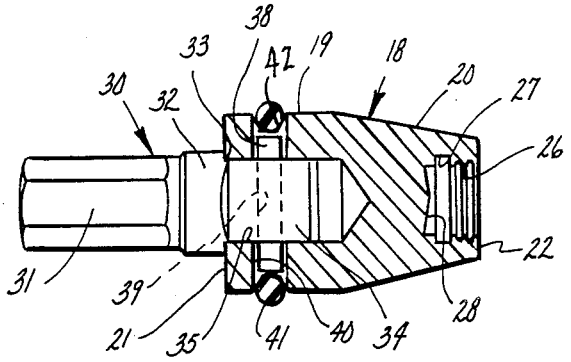
FIG. 2 is a view of the adaptor and driver unit illustrated in FIG. 1, and showing the same partially in cross section and detached from the anchor.
Figure 3:
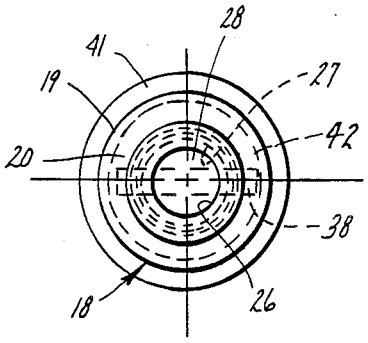
FIG. 3 is a right side elevation view of the adaptor and driver unit illustrated in FIG. 2.

The adaptor and driver unit comprising the driver 18 and the adaptor 30, shown in FIGS. 1 through 3, is illustrative of a unit of the type which may be made for driving adhesive capsule anchors having diameters of $\frac{1}{4}$ inch, 5/16 inch, $\frac{3}{8}$ inch and $\frac{1}{2}$ inch. It will be seen that the diameter of the threaded hole 26 in the driver 18 is dependent on the diametric sizes of the anchors 13 which are to be driven in place by a respective adaptor and driver unit.

Figure 4:
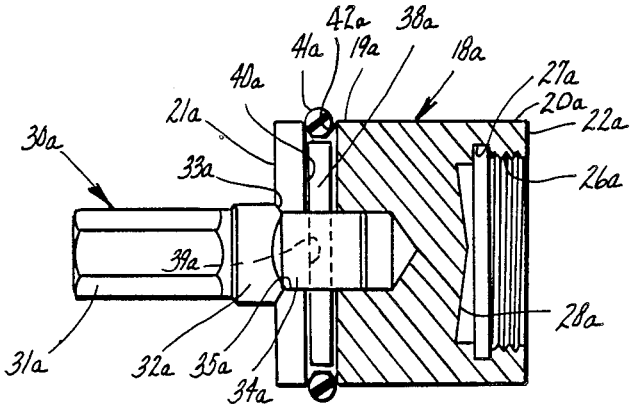
FIGS. 4 and 5 are views similar to FIG. 2, and showing two additional adaptor and driver unit embodiments of the invention.

FIG. 3 is illustrative of another adaptor and driver unit embodiment made in accordance with the principles of the present invention, and which is adapted for use with larger diameter anchors. The parts of the adaptor and driver unit embodiment illustrated in FIG. 4 which are the same as the parts of the adaptor and driver unit illustrated in FIGS. 1 through 3 have been marked with the same reference numerals followed by the small letter "a". The adaptor and driver unit shown in FIG. 4 would be employed for larger diameter anchors, such as anchors with diameters of $\frac{7}{8}$ inch, 1 inch and $1\frac{1}{4}$ inch.

Figure 5:
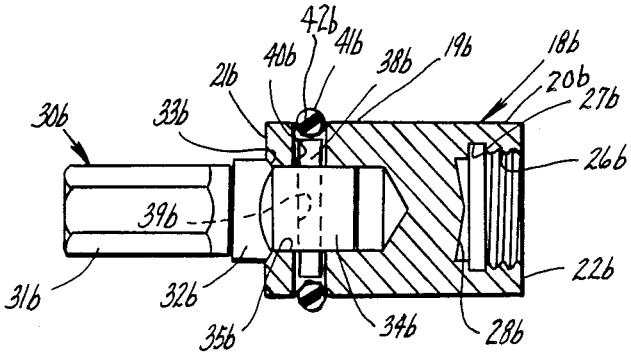

FIG. 5 illustrates still another embodiment of an adaptor and driver unit for anchors having a diameter larger than the anchor diameters handled by the adaptor and driver unit illustrated in FIGS. 1 through 3. The parts of the adaptor and driver unit illustrated in FIG. 5 which are the same as the parts of the adaptor and driver unit illustrated in FIGS. 1 through 3 have been marked with the same reference numerals followed by the small letter "b". The adaptor and driver unit illustrated in FIG. 5 would be employed for anchors having diameters of $\frac{5}{8}$ inch and $\frac{3}{4}$ inch.

What is claimed is:

1. An adaptor and driver unit for a threaded anchor that is to be rotatably driven into a breakable capsule, carrying a chemical adhesive disposed in a hole in concrete, masonry, rock or the like, comprising:

(a) a driver having a body with a threaded hole in a lower end thereof and an adaptor connector shaft hole in an upper end thereof, and which threaded hole terminates with an inner end wall, and the inner end of the threaded hole communicates with an undercut groove of a diameter larger than the diameter of said threaded hole;

(b) the threaded hole inner end wall being formed with a conical axial end surface for abutting engagement with the outer end of a threaded anchor which is threaded into said threaded hole;

(c) an adaptor having a drive shaft seated in the connector shaft hole in the driver body;

(d) attachment means for releasably securing the adaptor connector shaft to said driver body;

(e) said attachment means including a retainer pin operatively mounted in a transverse hole formed through the driver body and an aligned transverse hole formed through the adaptor connector shaft; and, (f) means for releasably holding said retainer pin in said transverse holes.

2. An adaptor and driver unit for a threaded anchor, as defined in claim 1, wherein:

(a) said means for releasably holding the retainer pin in said transverse holes comprises a flexible O-ring seated in a circumferential groove formed around the driver body and communicating with the ends of the transverse hole through the driver body.

* * * * *